US005208920A

United States Patent [19]

Schaefer et al.

[11] Patent Number: 5,208,920

[45] Date of Patent: May 11, 1993

[54] ADJUSTMENT SYSTEM FOR GARMENTS

[76] Inventors: Aaron Schaefer, 1415 N. Brand Blvd., No. H, Glendale, Calif. 91202; James Ranney, 1501 W. Olive, Burbank, Calif. 91506

[21] Appl. No.: 831,355

[22] Filed: Feb. 5, 1992

[51] Int. Cl.[5] ..... A41D 27/10

[52] U.S. Cl. ..... 2/269; 2/125; 2/227; 2/93; 2/108

[58] Field of Search ..... 2/269, 125, 227, 272, 2/108, 93

[56] References Cited

U.S. PATENT DOCUMENTS

| | | | |
|---|---|---|---|
| 560,683 | 5/1896 | Bruckner | 2/227 |
| 2,687,530 | 8/1954 | Farnum | 2/269 |
| 2,692,988 | 11/1954 | Rouse | 2/269 |
| 2,719,981 | 10/1955 | Walter | 2/269 |
| 3,111,681 | 11/1963 | Nelson et al. . | |
| 3,156,928 | 11/1964 | Colignon . | |
| 3,170,167 | 2/1965 | Isaacs . | |
| 3,665,516 | 5/1972 | Orovan . | |
| 3,722,001 | 3/1973 | Balley . | |
| 4,149,275 | 4/1979 | Sanchez . | |
| 4,200,938 | 5/1980 | LeTourneau . | |
| 4,241,461 | 12/1980 | Jolly et al. . | |
| 4,259,751 | 4/1981 | Drmaj . | |
| 4,573,218 | 3/1986 | Saggs . | |
| 4,896,379 | 1/1990 | Kape . | |
| 4,985,936 | 1/1991 | Jones | 2/269 |

*Primary Examiner*—Clifford D. Crowder
*Assistant Examiner*—Gloria Hale
*Attorney, Agent, or Firm*—Wagner & Middlebrook

[57] ABSTRACT

The present discloses an adjustment system for forming a repeatedly adjustable hem on a garment. There is provided an adjustment mechanism consisting of a cord with one end that is attached to the garment's inside hem while the other end is looped threaded through a holding pocket or channel that is secured to the garment's inside seam. The loop of cord above the holding pocket or channel is then preferably knotted. A fabric lining piece containing one or two lining windows is attached to the garment over the adjustment mechanism. Adjustment is made by opening the lining window, grasping the adjustment mechanism's loop and pulling it until the hem has turned up the prescribed amount. The loop is then placed back inside the lining window. The bloused lining is smoothed, the garment is pressed, and the adjustment is complete and undetectable.

15 Claims, 3 Drawing Sheets

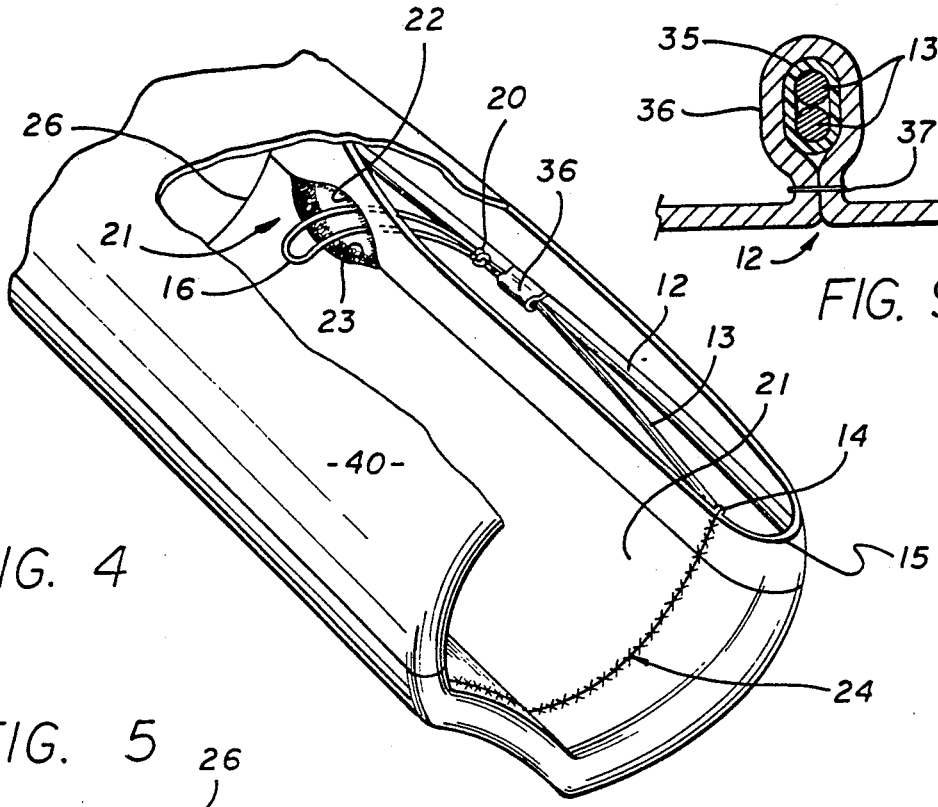
FIG. 4
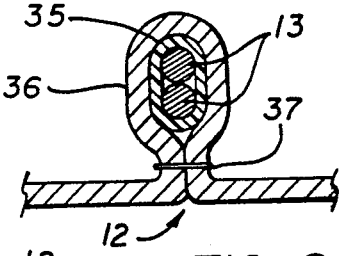
FIG. 9
FIG. 5
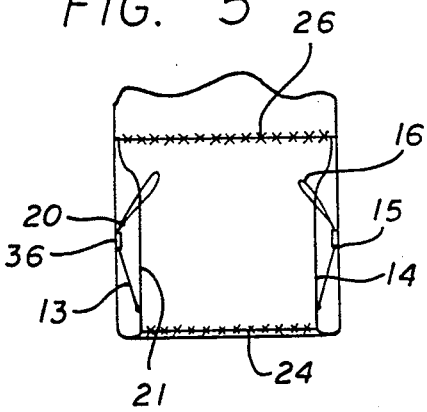
FIG. 7
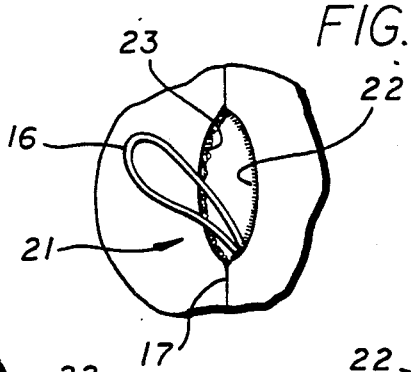
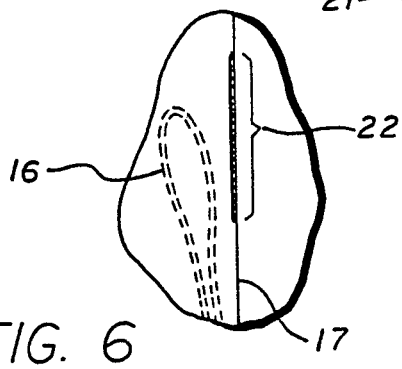
FIG. 6
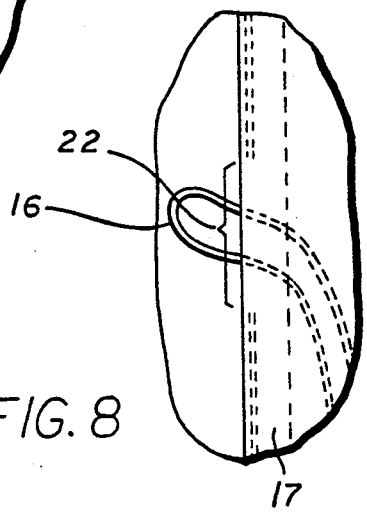
FIG. 8

ADJUSTMENT SYSTEM FOR GARMENTS

BACKGROUND OF THE INVENTION

This invention relates to the clothing arts and more specifically to a system that allows multiple adjustments to be made in sleeve and pant lengths. The system is fast and easy for anyone without tailoring skills to use, and the appearance of the garment is the same both before and after the adjustment. The system is particularly applicable to rental clothing (i.e., formal wear), since it frequently is necessary to adjust the length of the pant legs or jacket sleeves to conform to the individual's leg and/or arm length. However, the system also may be used to adjust the length of skirts, dresses and other items of clothing.

The traditional and typical method of adjusting the length of garments involves measuring the individual's inseam or outseam length (for pants) or arm length (from the nape of the neck in the center of the back, over the top of the shoulder down the arm to the wrist bone), and then to hem the garment to the predetermined length. To do this, the garment is folded inwardly until the desired length is reached and then this fold is stitched to the inside of the garment with a stitch such as the blind stitch. Next, the garment is usually pressed to provide a tailored edge.

This traditional method is costly, time-consuming and requires tailoring skills. Furthermore, each time an individual with different length arms and/or legs wears the garment, it is necessary to remove the stitching, readjust the length, and then restitch the hem and repress the garment.

Several solutions have been proposed using various means to effect the adjustment, such as hook and loop material (in either horizontal or vertical strips, or in circular patches), zippers and slide fasteners, permanent and removable stitching, and other fasteners such as snaps and buttons. See for example, U.S. Pat. No. 4,985,936; 4,896,379; 4,200,938; 4,573,218; 3,665,516; 4,259,751; 3,111,681; 3,156,928; 3,170,167; 4,241,461; and 4,149,275. One solution uses a detachable separately formed cuff. See 3,722,001. The Jones patent No. 4,985,936 uses a number of thin vertically elongated adjuster strips of the hook and loop variety attached to the inside of the garment (i.e., the pant leg). Four strips of the hook and loop material are attached to each pant leg. The garment is then folded to the proper length and the hook material is secured to the loop material.

None of these solutions has been adopted on a widespread commercial basis. The reason is believed to be because the bulk added by most fasteners is aesthetically unacceptable and the methods employing removable stitching make multiple adjustments tedious and require tailoring skills.

Therefore, it is the object of this invention to provide a system for the adjustment of garment length that can be used repeatedly, does not require any special tailoring skills, and does not add perceptible bulk to the garment.

These and other advantages and objects of this invention will become apparent from the following disclosure and defined in the appended claims.

BRIEF DESCRIPTION OF THE INVENTION

There is disclosed herein a system and technique for multiple adjustment of a garment's length, specifically sleeve and pant length. The system employs an adjustment mechanism, which consists of a sturdy cord or thread (such as upholstery thread) or flat tape, which is attached at one end to the bottom of the cuff and then is threaded through a flexible channel (attached to the inside seam), looped, threaded back through the channel, and attached to the cuff near the place of first attachment. Preferably, the cord is then knotted above the channel, leaving a loop of the cord. A second adjustment mechanism may be similarly attached along the opposite inside seam.

A lightweight fabric full or partial lining is constructed in such a way as to conform to the circumference of the pant leg or jacket sleeve at the places of attachment thereto. The lining is cut long enough to accommodate the desired adjustment range, with enough additional fabric to cover the adjustment mechanism. A short, i.e., one inch (1"), lining window is installed near the top and adjacent to the seam area on both sides of the lining. The lining window may be rimmed with hook and loop material or other fastening means for ease of opening and closing. The lining is then sewn to the pant or sleeve around the bottom and top circumferences using a blind stitch, the top and a straight stitch at the bottom entirely covers the adjustment mechanism.

The adjustment mechanism also can be installed in the same fashion in garments that are already lined, as long as lining windows are created. If the garment to be adjusted is a jacket sleeve, it may be desirable to modify the lining by inserting a small strip of stretchy material, approximately two inches (2") wide, into the lining material, either above or below the lining window. This is especially helpful where the sleeve is wider at the top than at the bottom.

It has been found that this system provides an inexpensive, easy, effective, repeatable, and commercially acceptable system.

BRIEF DESCRIPTION OF THE DRAWING

This invention may be more clearly understood from the following detailed description and by reference to the drawing in which:

FIG. 4 is a perspective view of an adjustable pant leg in the fully lengthened position;

FIG. 5 is a vertical cross section view of the adjustment system illustrating the location of the adjustment mechanism in relation to the garment's exterior fabric and the lining;

FIG. 6 illustrates the lining window in its closed position, showing how the loop of the adjustment mechanism is hidden from view;

FIG. 7 illustrates how the loop of the adjustment mechanism is pulled through the lining window, with the lining window rimmed with hook and loop fastener material;

FIG. 8 illustrates a lining window that does not use a hook and loop fastener; and FIG. 9 illustrates the holding pocket and flexible channel of the adjustment mechanism, showing the use of a round cord, and the channel's attachment to the garment's inside inseam or outseam.

DETAILED DESCRIPTION OF THE INVENTION

Figure 1A:
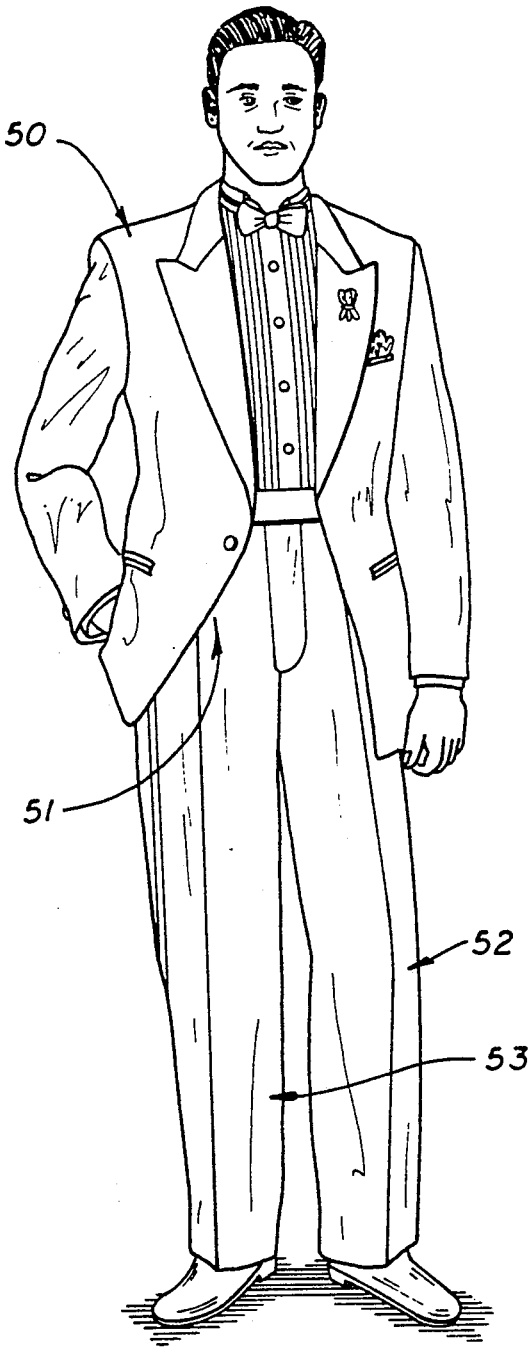
FIG. 1 is a view of two male figures (a) and (b), each of approximately the same build but with a several inch difference in height and arm length, wearing identical formal jackets and pants using the adjustment system of this invention showing the appearance upon wearing.
Figure 1B:
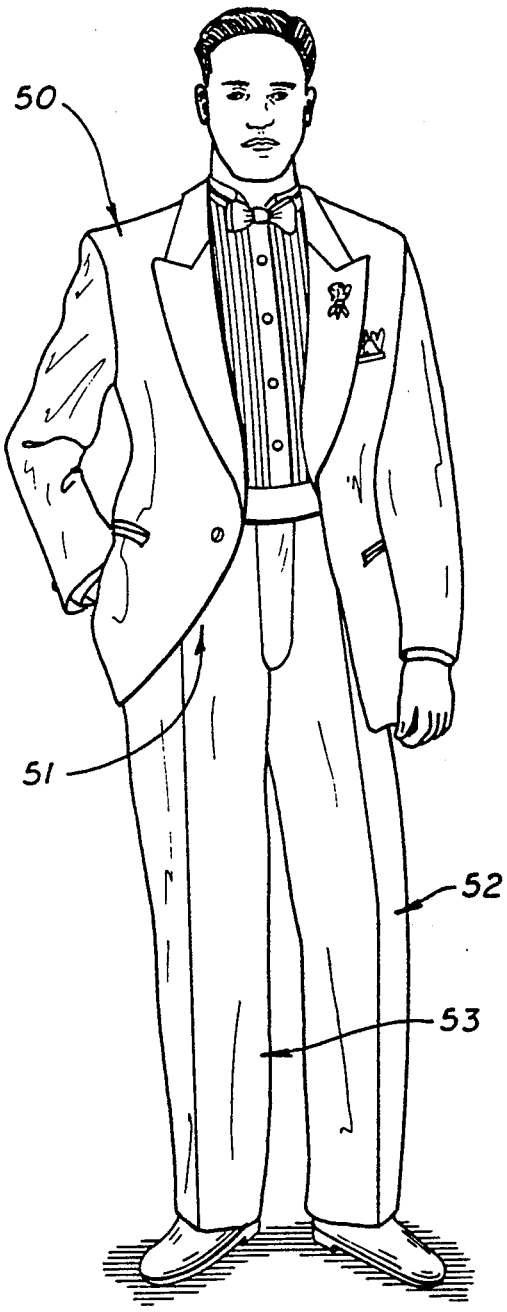

Referring now to the drawings, there is shown two male figures (a) and (b) generally of FIG. 1, both with approximately the same build but with a several inch difference in height and in arm length. These figures are wearing formal wear, consisting of a jacket 50 that has two sleeves and pants 51 that have two legs. Each leg of the pants has an outseam 52 and an inseam 53. Both have the length adjustment system in the sleeves and pant legs, but this system is invisible to both the wearer and the public.

The garments are donned in the usual manner without detection of the presence of the adjustment system. Virtually no additional bulk is detectable by the wearer. The adjustment between the two sizes, for example, 42 regular fitting someone 5'9" to 6'1" or 42S fitting 5'4" to 5'9 ½" or 42L fitting 5'11" to 6'5" depending on body type i.e., leg to torso ratio. The sleeve length in FIG. 1 changed by up to three inches (3") or any desired length in between and trouser lengths up to four inches (4") is a matter of a few minutes by non-tailor trained staff of the apparel or rental shop. Although illustrated in connection with formal apparel, it is also particularly suitable for clothing for growing adolescents.

Figure 2:
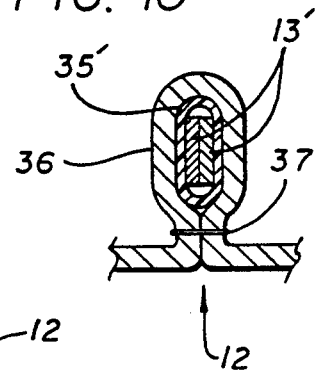
FIG. 2 is a perspective view of an adjustable sleeve in the fully lengthened position.

Referring now to FIG. 2, in which a jacket sleeve end 10 is shown, the exterior 11 is unchanged. The adjustment mechanism is located within the lining 21, which is stitched in its normal manner to the reverse fold 15 of the sleeve end. The sleeve's normal outer side seam 12 is shown in the broken away region.

Secured as by stitching of the seam 14 between the end of the reverse fold 15 and the lining 21 is a cord 13 that extends through a flexible channel 35 enclosed within a holding pocket 36 secured to the seam 12 material and invisible from either the exterior or the interior of the sleeve. The upper end of the cord 13 is formed into a loop 16 and knotted 20. The lining 21 contains a small lining window 22 through which the loop 16 of the adjustment mechanism may be reached for adjustment purposes. In the sleeve in FIG. 2, a small piece of stretchy material 30, having the same general circumference as the sleeve, has been inserted in the lining directly above or below the lining window 22. The lining window 22 is rimmed with hook and loop material 23 for closure purposes.

Figure 10:
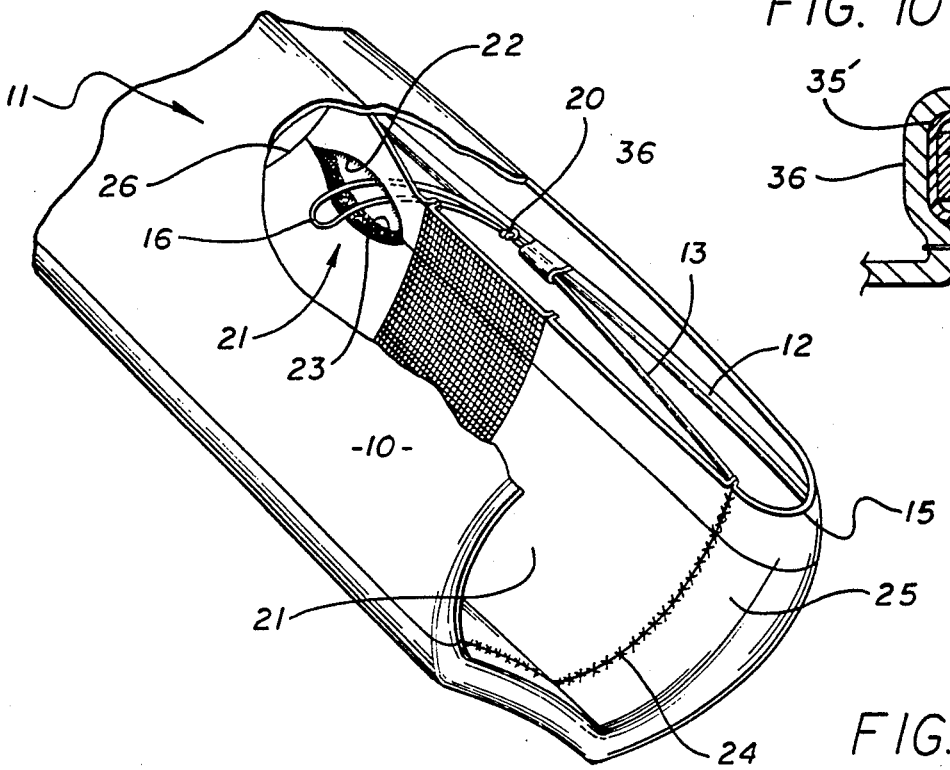

To install this invention on existing garments, in FIG. 2, the jacket's sleeve 10 is first turned inside out. Next, a sturdy cord or thread 13 (such as upholstery thread) or a flat tape (see FIG. 10), is securely attached at one end 14 to the original hem 25 of the jacket sleeve 10 along the sleeve's inside seam 12. The cord 13 is then threaded through a flexible channel 35 made of a length of soft plastic tubing (such as PVC) or of fabric. The flexible channel 35 has been previously enclosed in a holding pocket 36, consisting of a small rectangular piece of material, such as iron-on material, that has been also sewn for additional security, wrapped around the flexible channel 35 as in FIG. 9. The holding pocket is securely attached 37 FIG. 9 to the sleeve's inside seam 12 some inches up from the original hem 25, as shown in FIG. 2.

Figure 3:
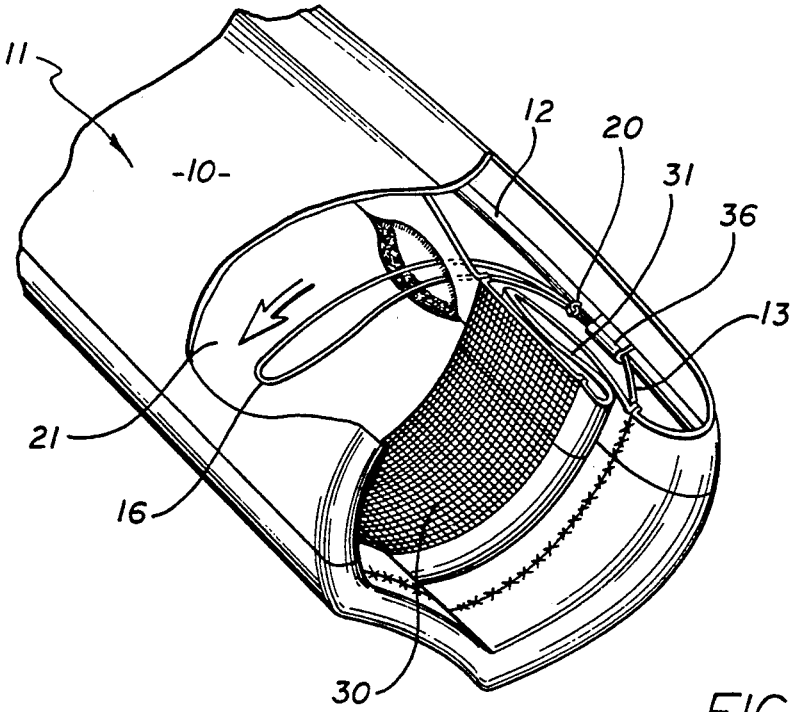
FIG. 3 is a perspective view of an adjustable sleeve in a shortened, post-adjustment position.

After the cord 13 has been threaded through the channel 35, the cord 13 is formed into a loop 16, threaded back through the channel, and attached to the sleeve's inside hem 14. The loop 16 of cord 13 is then knotted 20 above the holding pocket 35. This knot 20 prevents the cord 13 from slipping back through the channel 35, and keeps the loop 16 above that channel. This constitutes the adjustment mechanism 13, 16, 20, 35, 36, 37. An identical adjustment mechanism 13, 16, 20, 35, 36, 37 should be installed on the Opposite inside seam. FIGS. 2 and 3 show the end loops of the opposite seam adjustment mechanism.

The friction between the channel 35 and the cord 13 creates the force which keeps the cord 13 in place once an adjustment has been made. See FIG. 9. The channel 35 and the holding pocket 36 also serve as a guide to the cord 13.

A small rectangular piece of fabric lining 21 is cut to dimensions that conform to the circumference of the jacket sleeve 10 at the places where the lining will be attached 24, 26 to the sleeve 10. The length of the lining 21 should, at least, correspond to the maximum number of inches of adjustment that the user desires, with enough additional fabric lining 21 to cover the adjustment mechanism 13, 16, 20, 35, 36, 37. Since sleeves are normally lined, the existing lining will be used.

A small, i.e., one inch (1"), lining window 22 is cut into the fabric lining 21 seam near the top of the fabric lining 21 and adjacent to the seam 17 area on both sides of the fabric lining 21 (i.e., near each seam of the sleeve). In FIG. 7, hook and loop fastener material 23 has been attached to the edges of the lining window 22 for ease of opening and closing. In FIG. 8, no hook and loop fastener material 23 has been attached to the lining window 22. Instead, the lining window 22 has been left as a small slit in the seam 17 of the fabric lining 21.

The fabric lining 21 is then securely attached around the circumference of the sleeve 10 to the original hem 25 at the bottom of the sleeve 10, and to the fabric inside the sleeve 26 at an area above the holding pocket 36. The fabric lining 21 should be stretched taut up the inside of the sleeve 10 before the top attachment is made. The fabric lining 21 should entirely cover the adjustment mechanism 13, 16, 20, 35, 36, 37. Note that the adjustment mechanism 13, 16, 20, 35, 36, 37 is entirely hidden between the fabric lining 21 and the exterior fabric 11, except the loop 16 of the adjustment mechanism that temporarily has been pulled through the lining window 22.

With jacket sleeves, it may be desirable to modify the lining 21 by removing a strip of the lining 21 approximately two inches (2") wide and inserting therein a similarly sized stretch fabric panel 30 made of stretchy material. This insertion is made directly above or below the lining window 22. This stretch fabric panel 30 is especially helpful where the sleeve 10 is wider at the top than at the bottom.

FIG. 2 shows how the system is attached to a jacket sleeve. FIG. 4 shows how the system is attached to a pant leg. FIG. 5 is a cross-section view of the system as installed in a pant leg. The structure of the leg adjustment is nearly identical with that of the sleeve and the same reference numerals have been used to denote identical elements.

In FIG. 4, a pant leg 40, the exterior 11 is unchanged. The adjustment mechanism is located within the lining 21, which is stitched in its normal manner to the reverse fold 15 of the pant leg end. The leg's normal outer side seam 12 is shown in the broken away region.

Secured as by stitching of the seam 14 between the end of the reverse fold 15 and the lining 21 is a cord 13 that extends through a flexible channel 35 enclosed within a holding pocket 36 secured to the seam 12 material and invisible from either the exterior or the interior of the sleeve. The upper end of the cord 13 is formed into a loop 16 and knotted 20. The lining 21 contains a small lining window 22 through which the loop 16 of the adjustment mechanism may be reached for adjustment purposes. The lining window 22 is rimmed with hook and loop material 23 for closure purposes.

To install this invention on existing garments, in FIG. 4, the pant's leg 40 is first turned inside out. Next, a sturdy cord or thread 13 (such as upholstery thread) or a flat tape (see FIG. 10), is securely attached at one end 14 to the original hem 25 of the pant's leg 40 along the leg's inside seam 12. The cord 13 is then threaded through a flexible channel 35 made of a length of soft plastic tubing (such as PVC) or of fabric. The flexible channel 35 has been previously enclosed in a holding pocket 36, consisting of a small rectangular piece of material, such as iron-on material, that has been wrapped around the flexible channel 35 as in FIG. 9. The holding pocket is securely attached 37 FIG. 9 to the sleeve's inside seam 12 some inches up from the original hem 25, as shown in FIG. 4.

The cord 13 is formed into a loop 16, and threaded through the channel, and attached to the pant leg's inside hem 14. The loop 16 of cord 13 is then knotted 20 above the holding pocket 35. This knot 20 prevents the cord 13 from slipping back through the channel 35, and keeps the loop 16 above that channel. This constitutes the adjustment mechanism 13, 16, 20, 35, 36, 37. An identical adjustment mechanism 13, 16, 20, 35, 36, 37 should be installed on the opposite inside seam. FIG. 4 shows the end loop of the opposite seam adjustment mechanism.

The friction between the channel 35 and the cord 13 creates the force which keeps the cord 13 in place once an adjustment has been made. See FIG. 9. The channel 35 and the holding pocket 36 also serve as a guide to the cord 13.

A small rectangular piece of fabric lining 21 is cut to dimensions that conform to the circumference of the pant leg 40 at the places where the lining will be attached 24, 26 to the leg 40. The length of the lining 21 should, at least, correspond to the maximum number of inches of adjustment that the user desires, with enough additional fabric lining 21 to cover the adjustment mechanism 13, 16, 20, 35, 36, 37.

A small, i.e., one inch (1"), lining window 22 is cut into the fabric lining 21 seam near the top of the fabric lining 21 and adjacent to the seam 17 area on both sides of the fabric lining 21 (i.e., near each seam of the sleeve). In FIG. 7, hook and loop fastener material 23 has been attached to the edges of the lining window 22 for ease of opening and closing. In FIG. 8, no hook and loop fastener material 23 has been attached to the lining window 22. Instead, the lining window 22 has been left as a small slit in the seam 17 of the fabric lining 21.

The fabric lining 21 is then securely attached around the circumference of the pant leg 40 to the original hem 25 at the bottom of the leg 40, and to the fabric inside the leg 26 at an area above the holding pocket 36. The fabric lining 21 should be stretched taut up the inside of the leg 40 before the top attachment is made. The fabric lining 21 should entirely cover the adjustment mechanism 13, 16, 20, 35, 36, 37. Note that the adjustment mechanism 13, 16, 20, 35, 36, 37 is entirely hidden between the fabric lining 21 and the exterior fabric 11, except the loop 16 of the adjustment mechanism that temporarily has been pulled through the lining window 22.

The aforementioned steps need only be done once on each seam for each garment to modify it for future adjustments.

In use on a pant leg, the individual's inseam (crotch to instep) or outseam (top of the waistband to top of the heel of the shoe) is measured. In use on a jacket sleeve, the individual's arm length is measured (from the nape of the neck in the center of the back, over the top of the shoulder down the arm to the wrist bone). The jacket sleeve or pant leg is turned inside out for adjustment. With a sleeve, the sleeve length of the jacket is then measured to the correct dimension. The lining window 22 is opened and the adjuster reaches into it and pulls out the loop 16 of the adjustment mechanism.

If the sleeve is to be shortened, the loop 16 of the cord 13 is gently pulled until the original hem 25 has pulled the exterior fabric 11 of the sleeve around to approximately the length desired. The adjuster may measure the desired length of the sleeve and pin where necessary, if preferred. Once the proper length has been reached, all slack taken out of the loop below the channel, the loop 16 should be reinserted into the lining window 22, and the lining window should be closed. See FIG. 6. The end of the sleeve or pant leg is then lightly pressed.

The fabric lining 21 may tend to bunch up and the sleeve 10 with the attached fabric lining 21 should be neatly folded to the desired length. This will cause the fabric lining 21 to blouse 31 as illustrated in FIG. 3, which shows the sleeve 10 after the adjustment has been made and the sleeve 10 has been shortened. The adjuster should then turn the sleeve right side out and press it. To insure a more normal interaction with the wearer, a finishing button can be sewn in place to attach the fabric lining 21 to the base of the cuff. Such an attachment also may be achieved with "no-sew" options already on the market.

To lengthen a sleeve that has been shortened using this system, the adjuster should turn the sleeve inside out, open the lining window 22, reach into it and pull out the loop 16 of the adjustment mechanism. While holding the loop 16, the adjuster should pull on the hem of the sleeve, unrolling it to the desired length; verify length measurement and possibly pin the garment before pressing. Once the proper length has been reached, the loop 16 should be reinserted into the lining window 22, and the lining window should be closed. See FIG. 6. The adjuster should turn the sleeve right side out and press it.

A similar procedure is followed to shorten or lengthen pant legs that use this system.

The above described embodiments of the present invention are merely descriptive of its principles and are not to be considered limiting. The scope of the present invention instead shall be determined from the scope of the following claims including their equivalents.

What is claimed is:

1. A garment having at least one limb covering portion having an inside and an outside and having a generally tubular shape for covering a limb in which the length of the limb portion is desired to be adjusted without sewing, and wherein said limb covering portion is of a length at least as long as the greatest length desired; said limb portion having at least one longitudinal seam and having an upper end attached to a body portion of said garment and a lower end, in combination with a means for adjusting the length of the limb portion, said means comprising:

i. elongated flexible means having a first end, an intermediate portion and a second end wherein the first end of the elongated flexible means is attached to the inside lower end of the limb portion;

ii. means attached to the inside of the limb portion above the point of attachment of the said elongated flexible means to the limb portion for locating said intermediate portion of said elongated flexible means spaced from said first end;

iii. said elongated flexible means manually movable through said locating means;

iv. said elongated flexible men sand said locating means being in sufficient frictional engagement to maintain the lower end region of the limb portion in fixed length after manual adjustment; and including at least a partial lining for said garment limb portion, said lining covering said locating means and said elongated flexible means when the garment is worn and said lining having an opening therein to provide access to said elongated flexible means.

2. The combination in accordance with claim 1 in which said locating means is secured to said seam of the garment's limb portion.

3. The combination in accordance with claim 2 in which said elongated flexible means is secured to the end region of said limb portion in general longitudinal alignment with the said seam and locating means.

4. The combination in accordance with claim 1 in which said elongated flexible means is secured to the inside of said limb portion at the internal seam material.

5. The combination in accordance with claim 1 including a second such adjusting system on the opposite side of the inside of said garment limb portion from said first mentioned adjustment system secured to a second internal seam material of said limb portion.

6. The combination in accordance with claim 1 in which said locating means comprises a length of tubing extending generally longitudinally along said seam.

7. The combination in accordance with claim 1 in which said lining includes a closure means for said opening.

8. The combination in accordance with claim 1 in which said lining includes an insert of stretch material extending generally longitudinally to compensate for the overlap in lining after adjustment has been made.

9. A pair of pants or trousers including a trunk portion and a pair of leg portions in which the length of the leg portion is desired to be adjusted without sewing, and including leg portions of the length at least as long as the greatest length desired, and wherein said leg portions have at least one longitudinal seam and an end region; in combination with a means for adjusting the length of the leg portion, said means comprising:

i. elongated flexible means having a first end attached to the end region of a leg portion;

ii. channel means attached to the inside of the leg portion above the point of attachment of the said elongated flexible means to the leg portion;

iii. said elongated flexible means passing through said channel means and manually movable therethrough; and iv. said elongated flexible means and said channel means being in sufficient frictional engagement to maintain the end region of the leg portion in fixed length after manual adjustment; including at least a partial lining for said trouser leg portion, said lining covering said channel means and said elongated flexible means when the trousers are worn and said lining having an opening therein to provide access to said elongated flexible means.

10. The combination in accordance with claim 9 in which said channel means is secured to said seam of the trouser leg portion.

11. The combination in accordance with claim 10 in which said elongated flexible means is secured to the end region of said leg portion in general longitudinal alignment with the said seam and channel means.

12. The combination in accordance with claim 9 in which said elongated flexible means is secured to the inside of said leg portion.

13. The combination in accordance with claim 9 including a second such adjusting system on the opposite side of the inside of said trouser leg portion from said first mentioned adjusting system.

14. The combination in accordance with claim 9 in which said channel means comprises a length of tubing extending generally longitudinally along said seam.

15. The combination in accordance with claim 9 in which said lining includes a closure means for said opening.

* * * * *